US006138534A

United States Patent [19]

Cho

[11] Patent Number: 6,138,534

[45] Date of Patent: Oct. 31, 2000

[54] UNIVERSAL SOCKET FOR SOCKET WRENCH

[76] Inventor: Jin-Chai Cho, 2F, No. 26, Lane 43, Pa Te Road, Sec. 1, Taipei, Taiwan

[21] Appl. No.: 09/412,782

[22] Filed: Oct. 5, 1999

[51] Int. Cl.[7] ..... B25B 13/58

[52] U.S. Cl. ..... 81/185; 81/DIG. 11

[58] Field of Search ..... 81/185, 124.4, 81/124.5, DIG. 11, 439, 442, 448, 179, 461

[56] References Cited

U.S. PATENT DOCUMENTS

| | | | |
|---|---|---|---|
| 5,193,420 | 3/1993 | Smith | 81/185 X |
| 5,622,090 | 4/1997 | Marks | 81/185 |
| 6,023,999 | 2/2000 | Cho | 81/185 |

*Primary Examiner*—D. S. Meislin
*Attorney, Agent, or Firm*—Bacon & Thomas, PLLC

[57] ABSTRACT

An universal socket wrench, which includes a socket body for attaching to the workpiece to be turned, a locating block mounted in the socket body, the locating block having a plurality of through holes through top side and bottom sides thereof, a solid cover plate covered on the bottom side of the locating block, a pad covered on the top side of the locating block, the pad having a plurality of insertion holes respectively axially aligned with the through holes at the locating block, a plurality of spring members respectively mounted in the through holes inside the locating block, a plurality of rod members respectively inserted through the through holes at the pad into the through holes at the locating block and supported on the spring members, the rod members each having an outer end terminating in a holding down block suspended outside the locating block, and a plurality of connecting members stopped inside the locating block by the pad and respectively connected between the spring members and the rod members. The rod members are stopped at the top side and around the peripheral wall of the workpice when the socket body is attached to the workpiece, enabling the workpiece to be positive turned with the socket body by a handle being coupled to the socket body.

4 Claims, 4 Drawing Sheets

UNIVERSAL SOCKET FOR SOCKET WRENCH

BACKGROUND OF THE INVENTION

The present invention relates to a socket for socket wrench, and more particularly to a universal socket for socket wrench, which comprises a plurality of holding down rods arranged in parallel and supported on a respective spring member in a respective through hole at a locating block inside a socket body. When the universal socket is attached to the workpiece, the socket body is positively secured to the workpiece by the holding down rods, enabling the workpiece to be turned with the universal socket.

Regular socket wrenches are designed for use with a set of sockets for turning different sizes of bolts and nuts. There is known a socket for use with a wrench for turning different sizes of bolts and nuts. This structure of socket comprises a socket body, the socket body having parallel wells at one side thereof and a coupling hole at an opposite side thereof for coupling to a wrench, a plurality of spring elements respectively mounted in the wells inside the socket body, and a plurality of rod members respectively inserted into the wells in the socket body and supported on the spring elements. When the socket body is attached to the workpiece, the rod members are respectively attached to the topside wall and peripheral wall of the socket, enabling the workpiece to be positively turned with the socket. This structure of socket is still not satisfactory in function. When removing the socket from the workpiece, the rod members tend to be forced to fall out of the socket body.

SUMMARY OF THE INVENTION

The present invention provides a universal socket, which eliminates the aforesaid problem. According to the present invention, the universal socket comprises a socket body for attaching to the workpiece to be turned, a locating block mounted in the socket body, the locating block having a plurality of through holes through top side and bottom sides thereof, a solid cover plate covered on the bottom side of the locating block, a pad covered on the top side of the locating block, the pad having a plurality of insertion holes respectively axially aligned with the through holes at the locating block, a plurality of spring members respectively mounted in the through holes inside the locating block, a plurality of rod members respectively inserted through the through holes at the pad into the through holes at the locating block and supported on the spring members, the rod members each having an outer end terminating in a holding down block suspended outside the locating block, and a plurality of connecting members stopped inside the locating block by the pad and respectively connected between the spring members and the rod members. When the socket body is attached to the workpiece, the rod members are respectively attached to the topside wall and peripheral wall of the socket, enabling the workpiece to be positively turned with the socket. The diameter of the holding down block is greater than the insertion holes at the pad, therefore the holding down block of each rod member is constantly stopped outside the pad. Further, the diameter of the connecting members are greater than the insertion holes at the pad, therefore the connecting members are constantly maintained inside the socket body. Because the coupling portion of each rod member is respectively fixedly connected to the connecting members, the rod members will never fall out of the socket body.

DETAILED DESCRIPTION OF THE PREFERRED EMBODIMENT

Figure 1:
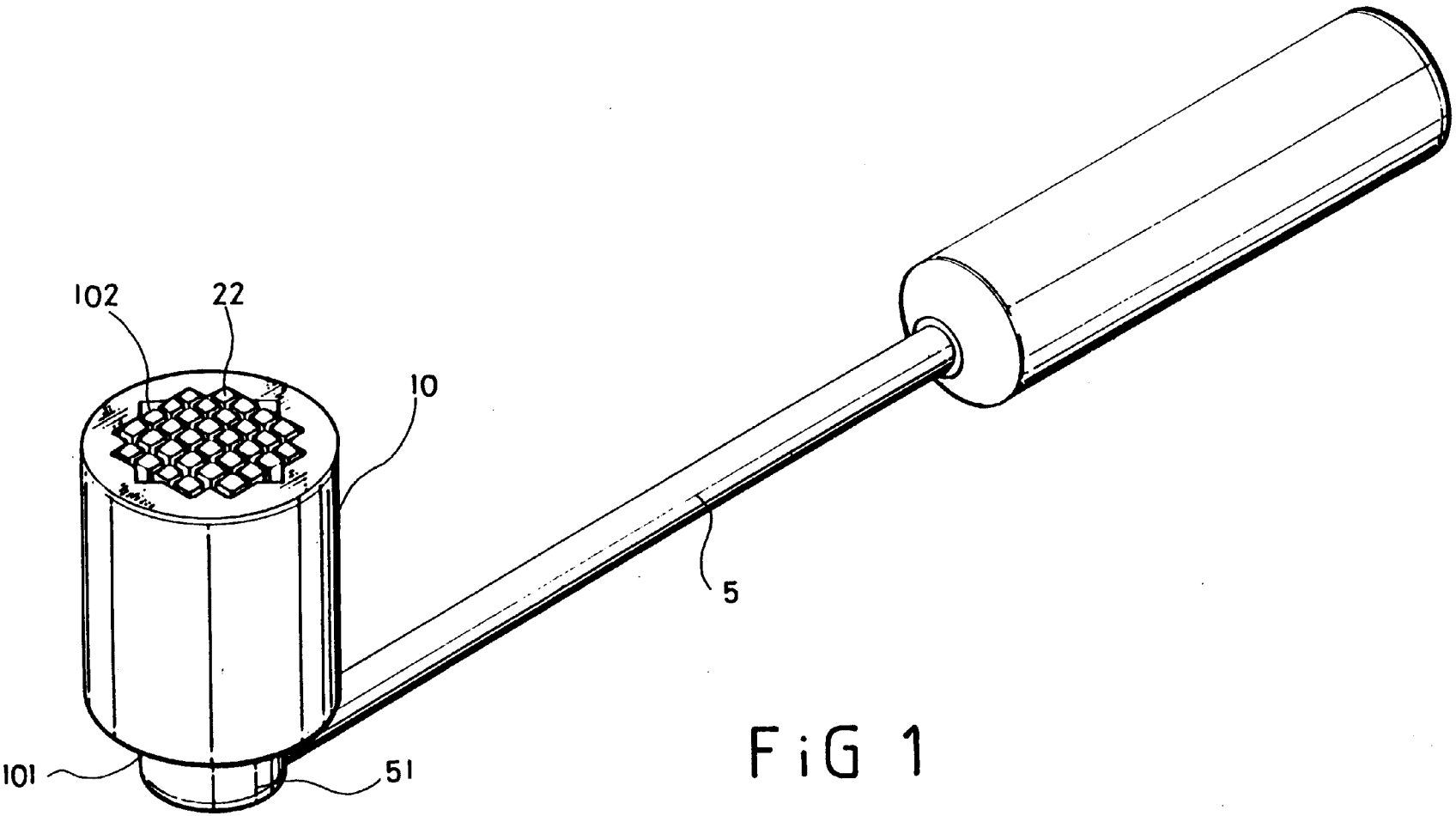
FIG. 1 is a perspective view of the present invention, showing the universal socket coupled to a handle.
Figure 2:
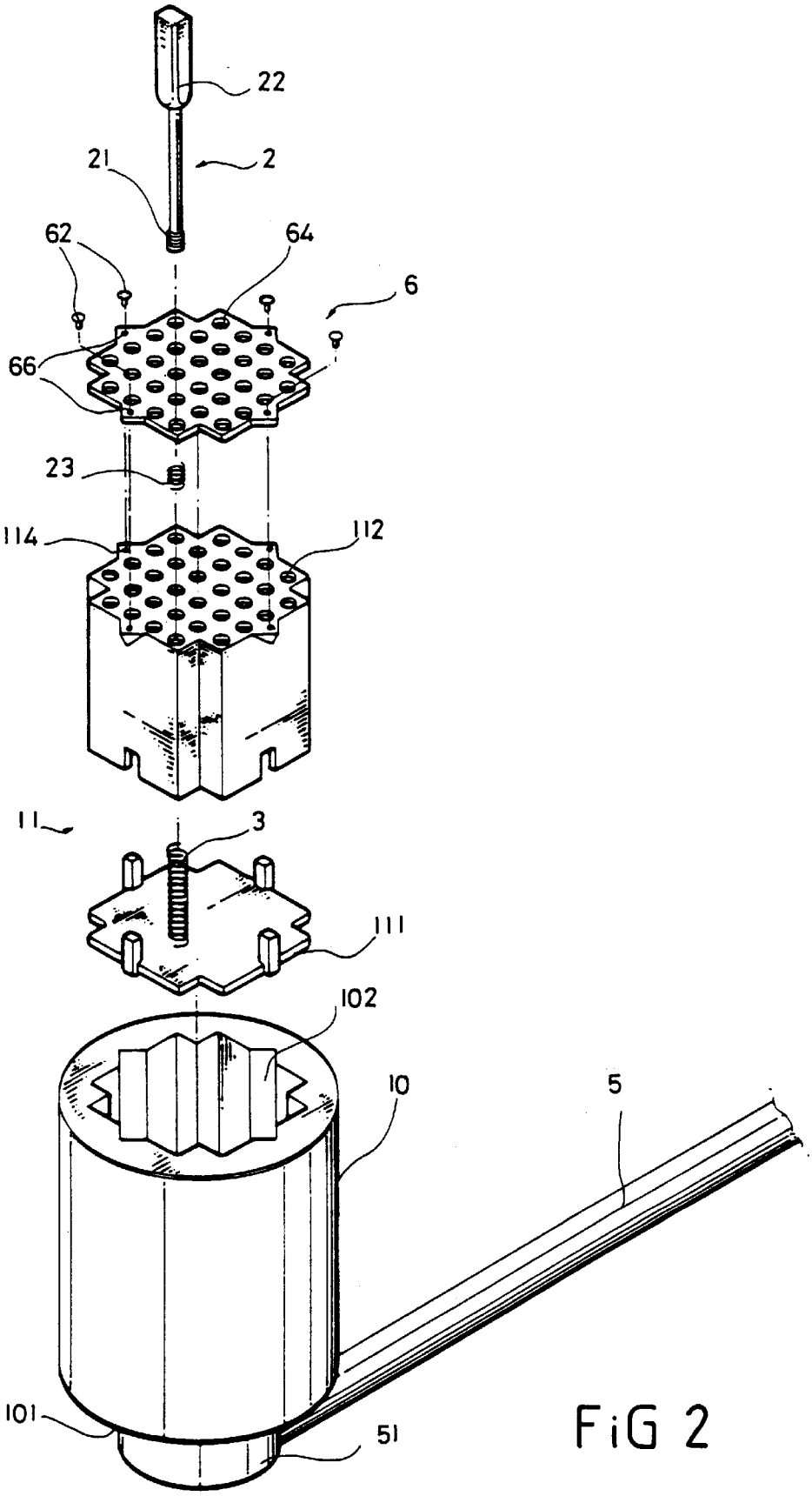
FIG. 2 is an exploded view of the universal socket shown in FIG. 1.
Figure 3:
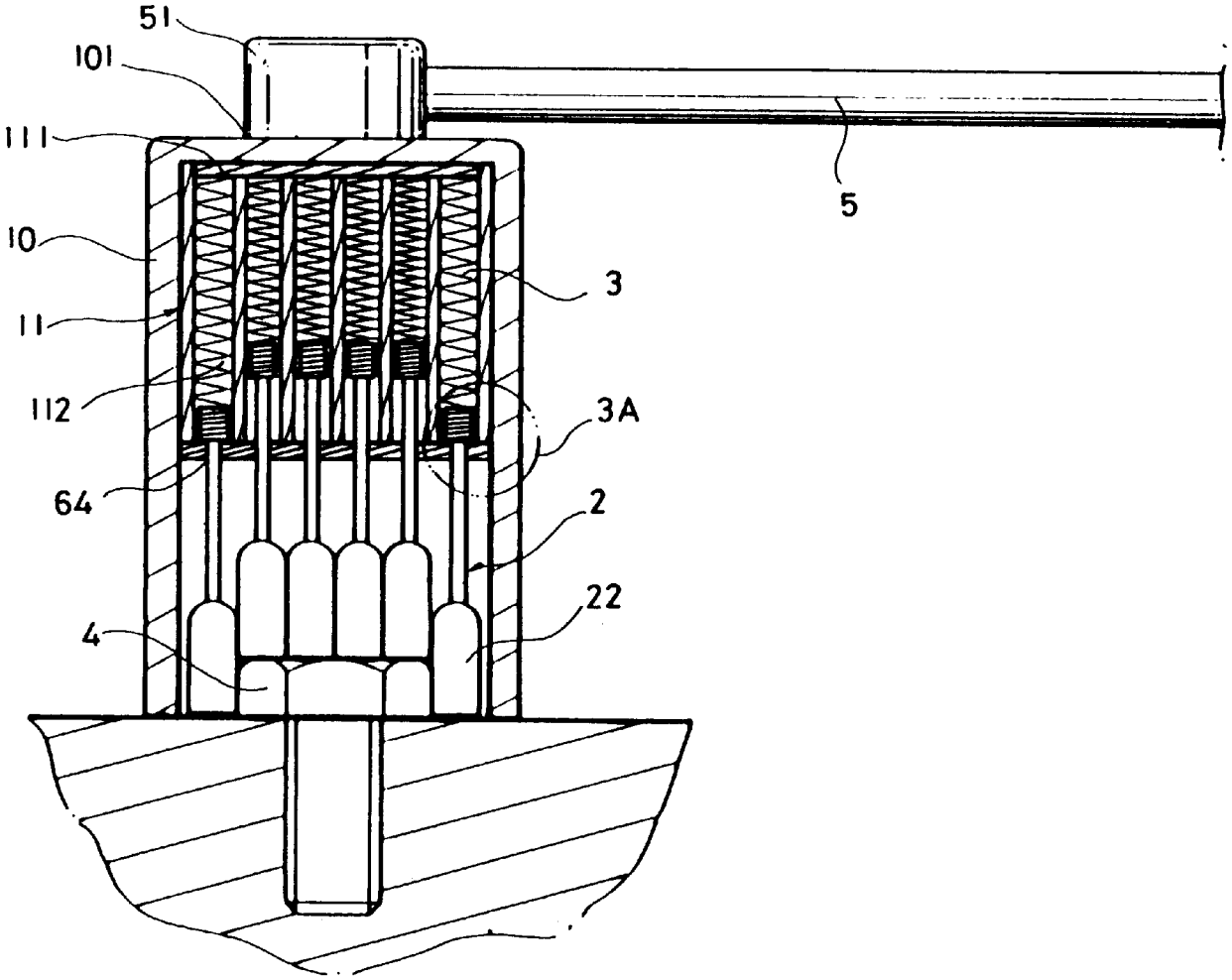
FIG. 3 is a sectional view of the present invention, showing the universal socket attached to the workpiece.
Figure 3A:
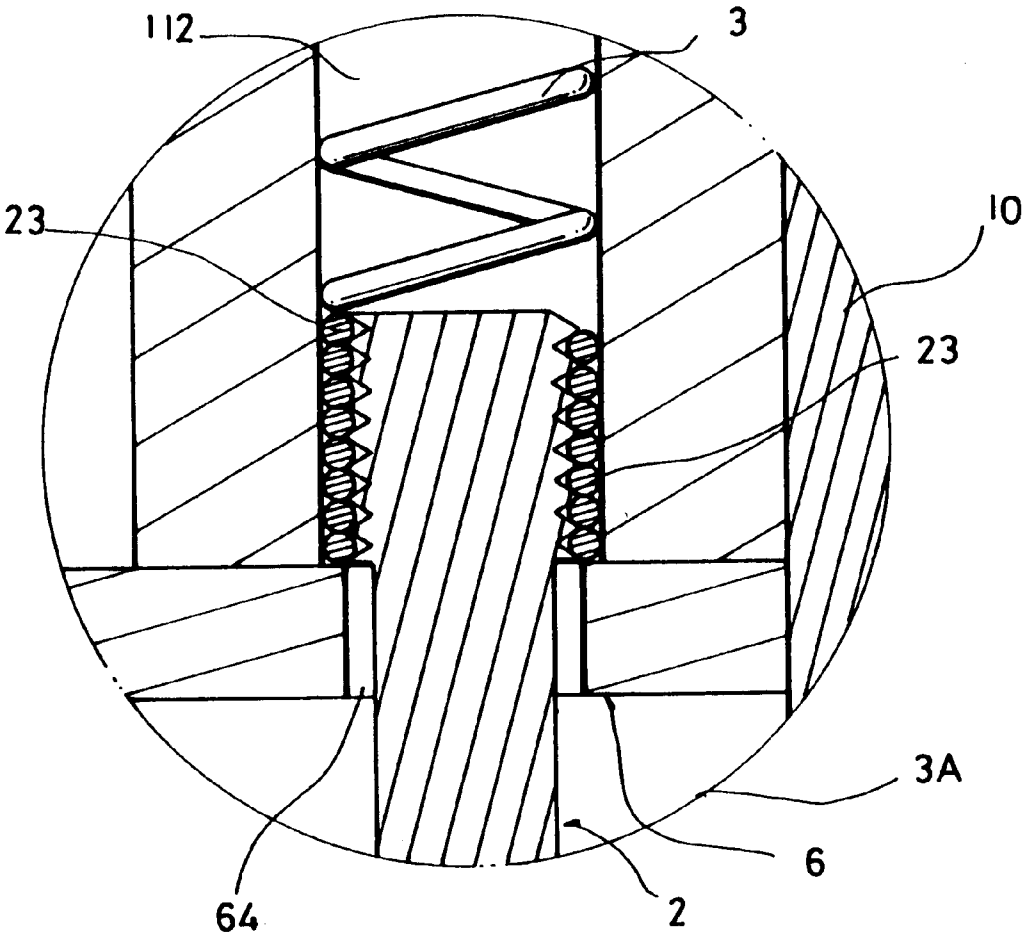
FIG. 3A is an enlarged view of a part of FIG. 3.

Referring to FIGS. 1, 2, 3 and 3A, a universal socket for a socket wrench in accordance with the present invention is shown comprised of a socket body 10 having a coupling hole 101 at one end and a locating hole 102 at an opposite end. A locating block 11 is mounted in the locating hole 102 inside the socket body 10, having a bottom side (namely, the inner side) covered with a solid cover plate 111, and a top side (namely, the outer side) covered with a slotted pad 6. The locating block 11 comprises a plurality of through holes 112 through the top and bottom sides thereof, and a plurality of screw holes 114 at the topside thereof. The pad 6 comprises a plurality of insertion holes 64 corresponding to the through holes 112 at the locating block 11, and a plurality of mounting holes 66 respectively fastened to the screw holes 114 at the locating block 11 by screws 62. Glue may be applied to the contact area between the pad 6 and the topside of the locating block 11, enabling the pad 6 and the locating block 11 to be bonded together. A plurality of spring members, for example, compression springs 3 are respectively mounted in the through holes 112 inside the locating block 11. A plurality of rod members 2 are respectively inserted through the through holes 64 at the pad 6 into the through holes 112 at the locating block 11, and supported on the compression springs 3. The rod members 2 each have one end terminating in a holding down block 22, and an opposite end terminating in a coupling portion 21. The coupling portion 21 of each rod member 2 is inserted through one insertion hole 64 at the pad 6 and connected to the compression spring 3 by a respective connecting member 23. The connecting member 23 can be a spring, a copper cap, or a plastic cap. The diameter of the connecting member 23 is greater than the diameter of the insertion hole 64. Therefore, the connecting member 23 is stopped in the respective through hole 112 in the locating block 11 by the pad 6. Further, the diameter of the holding down block 22 is greater than the diameter of the insertion holes 64. Therefore, the holding down block 22 of each rod member 2 is stopped outside the pad 6. Because the rod members 2 are respectively supported on the compression springs 3 in the through holes 112, the rod members 2 can be selectively moved in and out of the through holes 112. Further, a handle 5 is provided for turning the socket body 10. The handle 5 comprises a coupling block 51 perpendicularly disposed at one end thereof for engaging into the coupling hole 101 at the socket body 10.

Referring to FIGS. 3 and 3A again, when the socket body 10 of the socket wrench is attached to the hexagonal head of the bolt 4 to be rotated, the rod members 2 which are stopped at the top side wall of the hexagonal head of the bolt 4 are pushed backwards toward the inside of the locating block 11, and the rod members 2 which are not stopped at the tip side wall are closely attached to the peripheral wall of the hexagonal head of the bolt 4, enabling the socket body 10 to be positively secured to the hexagonal head of the bolt 4. Therefore, the bolt 4 can positively rotated inwards or outwards when turning the handle 5.

While only one embodiment of the present invention has been shown and described, it will be understood that various modifications and changes could be made thereunto without departing from the spirit and scope of the invention disclosed.

What the invention claimed is:

1. A socket for a universal socket wrench, comprising:

a socket body, said socket body comprising coupling hole at one end thereof, and a locating hole at an opposite end thereof for attaching to the workpiece to be turned;

a locating block mounted in the locating hole inside said socket body, said locating block having a top side, a bottom side, a plurality of through holes through said top side and said bottom side, and a plurality of screw holes at said top side;

a solid cover plate covered on the bottom side of said locating block inside said socket body;

a pad covered on the top side of said locating block inside said socket body, said pad comprising a plurality of insertion holes respectively axially aligned with the through holes at said locating block, and a plurality of mounting holes respectively fastened to the screw holes at said locating block by a respective screw;

a plurality of spring members respectively mounted in the through holes inside said locating block;

a plurality of rod members respectively inserted through the through holes at said pad into the through holes at said locating block and supported on the spring members in said locating block, said rod members each having a holding down block suspended outside said locating block and said pad and a coupling portion supported on one spring member in said locating block; and a plurality of connecting members stopped inside the through holes at said locating block by said pad and respectively connected between said spring members and the coupling portion of each of said rod members.

2. The universal socket wrench of claim 1 wherein said connecting members are spring elements.

3. The universal socket wrench of claim 1 wherein said connecting members are copper caps.

4. The universal socket wrench of claim 1 wherein said connecting members are plastic caps.

* * * * *